US005400382A

United States Patent [19]

Welt et al.

[11] Patent Number: 5,400,382

[45] Date of Patent: Mar. 21, 1995

[54] AUTOMATED IRRADIATOR FOR THE PROCESSING OF PRODUCTS AND A METHOD OF OPERATION

[75] Inventors: Martin A. Welt, Morris Plains; Craig W. Barnett, Denville, both of N.J.

[73] Assignee: Alpha Omega Technologies, Inc., Cedar Knolls, N.J.

[21] Appl. No.: 872,542

[22] Filed: Apr. 19, 1992

[51] Int. Cl.[6] ..... G21K 5/10

[52] U.S. Cl. ..... 378/69; 378/64; 426/240; 250/453.11; 250/454.11

[58] Field of Search ..... 378/67, 69, 64; 250/436, 437, 438, 453.11, 482.1; 99/451; 426/240

[56] References Cited

U.S. PATENT DOCUMENTS 4,029,967 6/1977 Tetzlaff ..... 378/69
4,066,907 1/1978 Tetzlaff ..... 378/69
4,151,419 4/1979 Morris et al. ..... 378/69
4,788,701 11/1988 Barrett ..... 378/69
4,852,138 7/1989 Bergeret et al. ..... 378/69
4,866,281 9/1989 Bosshard ..... 378/69
4,908,221 3/1990 Barrett ..... 378/69

*Primary Examiner*—Paul M. Dzierzynski
*Assistant Examiner*—Chu, Kim-Kwok
*Attorney, Agent, or Firm*—Hopgood, Calimafde, Kalil & Judlowe

[57] ABSTRACT

The invention describes the facility and method for controllably irradiating materials with gamma rays. Specifically, the invention concerns the processing of foodstuffs, medicines and other products by remote-controlled exposure to a radiation source while being transported by pallet carriers at adjustable distances in two parallel roller type assemblyline toting systems. A further feature of the invention is the computer-linked automated dosimetry system which is used to afford an effective protocol for product preservation, sanitization or sterilization as well as safety.

26 Claims, 4 Drawing Sheets

AUTOMATED IRRADIATOR FOR THE PROCESSING OF PRODUCTS AND A METHOD OF OPERATION

BACKGROUND OF THE INVENTION

This invention relates to an automated process and facility for treating or sterilizing foods, nutrients, potables, medicine and other products by gamma-irradiation. It provides automatic controls for monitoring, transporting, and irradiating such materials in predetermined programs designed for adequate and uniformly effective processing or sterilization.

Gamma radiation for commercial or industrial treatment or sterilization of food substances has been increasingly utilized since its inception in several countries since the 1970's. The commercial application of irradiation to sterilize medical devices has been applied on a worldwide basis because of a continuing concern about the side effects and safety of some of the chemical fumigants vis-a-vis contact with the population in general and also accumulation in the food chain. Irradiation of pork, poultry, grain, potatoes, fruits and vegetables, enzymes, herbs, and spices has been approved by the U.S. Food And Drug Administration. The approval of this treatment has recently been broadened to encompass the disinfestation and shelf-life extension of fruits and vegetables and to increase the maximum doses for spices.

Gamma radiation was first observed at the turn of the century and shows many similarities to x-rays. It is, however, of a shorter average wavelength and due to spontaneous disintegration of radioisotopes. Most commonly, Cobalt-60 and Cesium-137 are used as radiation sources for a variety of medical and industrial applications, including sterilization.

Small doses of gamma radiation are found sufficient to eliminate the viability of virtually all types of microorganisms, its efficiency being comparable to extreme heat or chemical sterilants. "Rad" is the basic measure for "the radiation absorbed dose" as the amount of irradiation received by a product under treatment. Typically, doses administered may range from a low of 6 kilorads (6000 rads) for sprout inhibition or 25 kilorads (25,000 rads) for insect disinfection of fruit to 2.5 megarads (2,500,000 rad) used for the sterilization of medical products.

The advantages of gamma irradiation as a method of processing or sterilization reside in the limited number of variables that have to be controlled as it is independent of temperature, pressure and humidity. Gamma rays can penetrate all forms of packaging materials, including glass and metal containers. Thus foods and the like can be treated uniformly and quickly. At the dosage required for food processing and medical-product sterilization, the molecular structure of these products, is not adversely affected. Moreover, the internationally approved or U.S. approved gamma irradiation process cannot cause any material being irradiated to become radioactive.

In order to preserve the nutritious quality of foodstuffs or efficacy of medical and pharmaceutical products during irradiation, the process should involve a great deal of flexibility and adjustability depending on the required radiation dosage.

The U.S. Pat. No. 4,029,967 describes a device wherein a radiation source, such as cobalt-60, is surrounded in a circle by an array of shielding means and gaps for controllably irradiating the various goods which are positioned in adjacent cylindrical or box containers. As the distance between radiation source and radiation target center remains constant, the containers must be intermittently or continuously rotated as well as relocated in the circle around the radiation source and shielding means to avoid overdosing the goods.

Another approach has been to irradiate the materials by moving them in pallets sequentially on two parallel tracking paths past the radiation source in the source rack, such that first one side and then the other will be exposed for an appropriate amount of time. Given the various dose requirements for different materials being irradiated, location of the pallets close to the gamma radiation source can result in damage to more exposed sections when trying to achieve desired minimum doses.

Moreover, large changes in the required product dosage in the known systems would entail hazardous manipulation or exchange of the intensity or strength of the radiation material. This complicated manipulation of the sterilization process thereby resulted often in loss of time, value, and overall efficiency.

Moreover, with the growing need for efficiently keeping track of the product location and treatment within the official regulations, the ability to measure and monitor the irradiation process has paramount importance and thus spawned the development of computerized technologies.

The problem of the desirable uniformity of irradiation and concomitant efficacy in treatment has led to intensive search for an automated dosimetry of irradiation combined with mechanical features which allow ease of handling and greater economy as well as safety in the use of the irradiator.

SUMMARY OF THE INVENTION

In order to effect sterilization of materials such as cosmetic, medical and pharmaceutical products, sanitization of cosmetic products, as well as treatment for the preservation of nutrients, food and potables, it is the object of the present invention to provide a securely shielded facility of the gamma-radiation type which comprises a radiation source and a dual means for conveying material to be irradiated in parallel direction at adjustably proximal positions to the radiation source while affording a high throughput rate. For protective shielding the facility has a radiation-absorbing wall enclosure open at one end where recessed within the enclosure an interior wall complex is located and shaped to permit barrier-free conveyance of products to and from the irradiation source.

In particular, the present invention is directed to an irradiation facility for controllably irradiating a plurality of products with gamma-rays comprising a radiation source, means for loading product to be irradiated on a plurality of carrier means, conveyor means for conveying product carrier means to two dwell units positioned in parallel proximity of the radiation source, means for adjusting the position of the dwell units on either side of the radiation source, means for adjusting the position of the product carrier means on the dwell units, means for storing the radiation source in a radiation protective storage tank, which comprises a water-filled storage pool or a dry storage shielding cask, means for moving irradiating source into position for applying irradiating dosage to each carrier, and computer-linked automatic controls therefor.

In particular, the plurality of material comprises food, nutrients, or potables, cosmetic, medical or pharmaceutical products, toxic or infected waste. The applied irradiation dose serves to preserve, process, sanitize or sterilize.

It is the object of the invention to provide a virtually infinite variability of pallet position to adjust the product's centerline dose rate. For that purpose, it is a convenient object of the invention to adjust the position of the dual tracktype conveyance means or carrier means connected thereto, so that the material to be irradiated can be moved laterally or perpendicularly to positions at various distances from the radiation source.

It is therefore the object of the invention to provide two parallel dwell units positioned on either side of the radiation source rack wherein the dwell units comprise preferably motorized roller type conveyance sections. The individual dwell units, in turn, are carried by a lorry platform and rail system, thus providing transportation of the product into as close a vicinity of the radiation source as desirable.

It is another object of the invention to hold the material to be irradiated on dual track-type conveyance or carrier means, such as dwell units, for different required periods of time.

It is also the object of the invention to economically, yet effectively, provide a tote system to convey the treatable product on a pallet-type conveyance or carrier means in sequence to each other.

It is further the object of the invention to provide a high pallet capacity, preferably up to 1200 kg, at relatively low cost. It is also the object of the invention to provide a high processing capacity, preferably up to 1440 kg/min at relatively low cost.

It is a convenient object of the invention to use a hydraulic hoist operated radiation source rack.

It is another convenient object of the invention to provide conveyance of pallets to and from the cell on motorized rollers.

Further to the invention, a preferred embodiment is directed to an irradiation facility for the remote-controlled treatment of products or materials comprising a radiation source, a conveyance system for transporting the products or materials on at least two movable parallel conveyors in a suitable proximity of the radiation source, the conveyance system having a plurality of carriers for the products or materials to be irradiated, the carriers being selectively transported to control speed, time and duration of irradiation, the parallel track conveyance system having motorized means to vary the track position relative to the radiation source, and the remote control of the irradiation process being monitored and directed by a computer-linked reader system, the reader system being a laser-equipped detection device.

The object of the embodiment includes the remote-controlled use of the facility for treatment of products or materials such as preserving or sterilizing foods, cosmetic, medical or pharmaceutical products; radiation processing of bonding plastics, alloys, or emulsions; sterilizing or inactivating waste products; or radiation processing or sterilizing of food packages or utensils. The remote-controlled treatment further includes a loadshifting adjustment for uniformly irradiating product on pallets which are smaller than standard size.

The object of the present invention is directed to a method for controllably irradiating a product with gamma-rays in an irradiation facility, comprising the steps of placing the product to be irradiated in a carrier means mounted on a roller conveyor means; moving the carrier means on the conveyor means with connecting shuttle means to different positions on parallel conveyor tracks in dwell units proximal to the radiation source; adjusting the distance of the parallel conveyor tracks respective the radiation source; placing the radiation source into position for irradiation; irradiating the product with a radiation dosage; and optionally monitoring by a sensor means and controlling by the remote control means, the position of the parallel conveyor tracks, the placement of the radiation source, and the dosage of irradiation.

A further object of the present invention is directed to the method wherein the product comprises food, nutrients, or potables, cosmetic, medical or pharmaceutical products, infected or toxic waste substances; wherein the controlled irradiation comprises a preserving, inactivating, or sterilizing dose.

One important object of the present invention is directed to a method for treating food, medical or cosmetic products, utensils, devices or other products or materials by the remote-controlled irradiation with gamma-rays comprising the steps of placing product to be irradiated on a plurality of carriers, the carriers being mounted in an assemblyline tote system and being connected to remote control means; the assemblyline tote system comprising at least two parallel conveyor tracks positioned in proximity to a radiation source connected to the remote control means, moving by remote-control the parallel conveyor tracks to different positions in the proximity of the radiation source to effect radiation processing and monitoring the remote-controlled irradiation process by an automated dosimetry system using bar-code labelling and radiation colorimetry.

The inventive method is directed to using the assemblyline tote system which comprises conveyance controls allowing loadshifting of smaller than standard size carriers for uniform irradiation.

Another object of the invention is the computer-linked sensor means which provides the means to monitor and remotely control the operation of conveying, positioning, and irradiating the material to be treated. In this context, the object of invention uses bar code scanning to control entrance conveyor and to ensure a proper product irradiation cycle.

The dosimetry system in accordance with one aspect of this invention is designed to combine specialty polymer, automatic identification and microcomputer technologies into an information and control system for efficiently monitoring and reporting the use of radiation processing. Still other uses and advantages of the present invention will become apparent from the following description of the invention and of the preferred embodiments.

DESCRIPTION OF THE PREFERRED EMBODIMENTS

Figure 1:
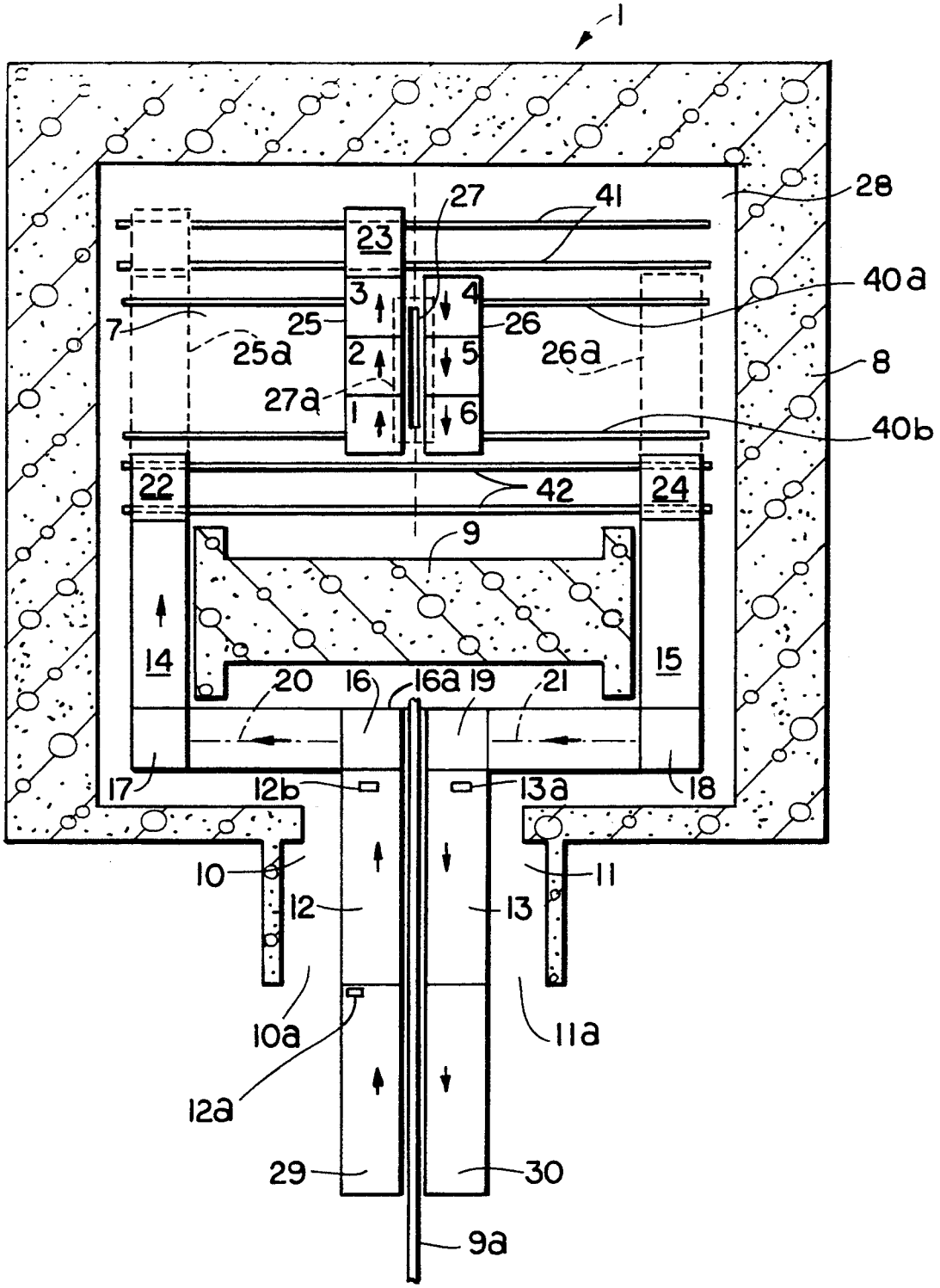
FIG. 1 is a top plan view of an Irradiation Chamber in accordance with the present invention.

Reference should now be had to the drawing, FIG. 1, wherein a layout of the T6-V Irradiator facility is shown.

The irradiating facility is an essentially rectangular protective enclosure 1. The concrete shielding walls 8 and 9 enclose a central space known also as the radiation room 28 (or the "Cell"). The interior wall 9 is sufficiently recessed from the entrance opening 10 and parallel exit opening 11 to provide space for access and egress through labyrinth-type passages, i.e. the entrance 10 and exit 11 maze, respectively. The mazes are constructed sufficiently wide to allow space for the product conveyance system and the personnel walkway. Usually the preferred width ranges from about two to about three meters.

The conveyor system is shown as having an accessing track 14 to bring product to be irradiated into the Cell 28, and an exiting track 15 bringing product after irradiation out. The conveyor system is made up of roller conveyors 12, 13, 14, 15, roller conveyor pop-up transfers 16, 17, 18, 19, chain conveyors 20, 21 and shuttle cars 22, 23, 24 for moving pallets of product into, through and out of the Cell 28 inside the irradiator facility. The pop-up feature provides a way to compensate for the distance between the level at which the pallets hang from the chain conveyors and the top of roller conveyors.

The facility is provided with conveyor line 29 at the entrance portion and conveyor line 30 at the exit for loading or unloading the pallets of product, respectively. These conveyors are separated from each other by a concrete wall 9*a*.

Two parallel conveyance track lines 25 and 26, also known as dwell units, carry product carrier devices or platforms past the radiation source 27. The preferred dwell unit configuration preferably provides space for up to three pallets.

In one advantageous embodiment, the product is moved on shuttle cars 22, 23, 24, between dwell units 25, 26. The dwell units consist of sections of roller conveyor. A further advantage of the inventive design is achieved by the product entering and exiting through separate maze passages which ensure separation of treated and untreated product.

The dwell units 25, 26 are provided with the additional advantage in that these roller sections themselves can be moved into different, but equal distances from the flat radiation surface of the planar source rack 27 which is positioned between them. A preferred embodiment provides for the dwell units 25, 26 to be mounted on a modified lorry and rail system wherein the roller sections are carried by platforms or chassis on wheels which are rolling on a dual rail track 40*a*, 40*b* in perpendicular direction to the roller sections 25, 26 and the radiation source rack 27.

All maze passages are protected against inadvertent entry by safety interlocks designed to shut the system down if activated or broken. Safety interlock monitoring devices are included at the entry point 10*a* of the entrance maze 10 and the exit point 11*a* of the exit maze 11, at the joints between conveyors 12 and 29, as well as 13 and 30, midway along the entrance and exit mazes. The inventive embodiment also provides monitoring devices within the Cell 28. Thus each length section of product conveyance track is equipped to monitor the location and movement of pallets through the irradiator.

Of course, it should be understood that the facility is not limited to either the location or the number of monitoring devices. The monitoring system can be operated by the use of photo-eyes, limit switches and bar code readers.

In one preferred system according to the present invention, the radiation system used in the T6-V Irradiator chamber is designed to operate in a fully automatic mode. The source rack has the capability of containing hundreds of Cobalt source pencils held in modules which are assembled into a stainless frame or source rack 27. A typical rod is a double-walled stainless steel capsule approximately 18-inches long and about ⅜ inch in diameter. It contains up to 10,000 curies of radioactive Cobalt-60. Cobalt-60 has a half life of about 5.26 years and gives off gamma rays of 1.17 and 1.33 million electron volts per disintegration. Alternatively, the radioactivity source can consist of Cesium-137.

The fraction of the energy emitted by the source 27 that is absorbed by the product, determines the efficiency of the machine. Depending on the pallet loading and the density of the product, efficiencies may range from 18% to 35%. In the preferred embodiment T6-V, the ventilation system is specially designed and engineered to assure that the point of lowest pressure in the irradiation plant is in the vicinity of the Cell 28. The ventilation system also assures that the ozone level within the radiation room is below the approved TLV of 0.1 ppm before a worker can gain entry after lowering the source rack 27 into the storage pool 27*a*.

The radiation source of the preferred embodiment described here is a structure called the Source Rack 27. It contains the radioactive Cobalt used in irradiating product in the dwell positions on the dwell unit. The source rack 27 in one specification is approximately 6 ft. by 8 ft. by 2 in.

The source rack 27 is kept in a storage pool 27*a* filled with demineralized water which acts as a biological shield. For use, the source rack 27 is raised by hydraulic hoist from its storage position in the water pool 27*a* below the floor slab to an in-air irradiation position within the concrete shielded Cell 28.

The raising and lowering of the source rack 27 is preferably remote-controlled and actuated by a computerized control system. This system is safely interlocked with the entire facility.

According to one preferred embodiment of T6-V, each plant has primary and backup radiation survey instrumentation, maze monitors, analyzers for water sampling as well as personnel badges which are read periodically. The shielding pool water passes through a demineralizer in a closed loop, and is surveyed for traces of radioactivity. The system design does not permit any drain lines to connect from the Water Treatment System Room area to outside the building.

Moreover, in the preferred embodiment as described above, a chain conveyor 20 or 21 is used as a transfer between two roller conveyors 12 and 14 or 13 and 15 at points of entry 10 or exit 11, respectively, to and from positions proximate to the radiation source 27. The main method of conveyance through the systems is on rollers.

Each of the two dual tracks 25 and 26 of the preferred T6-V Conveyor System is referred to as a Dwell Unit. Each Dwell Unit 25, 26 has a roller conveyor in parallel position to the source rack 27. The Dwell Unit 25, 26 is moved closer to or further from the source rack 27 using a motor and chain system which drives the Dwell Unit along on a set of rails (see FIG. 4 and Example 5). The length of the Dwell Unit is approximately 30 feet 6 inches. In the preferred layout, the roller top of each Dwell Unit is divided into sections (1, 2, 3; 4, 5, 6) of approximately even lengths, each equipped with its own electric or pneumatic motor.

In order to facilitate the efficient irradiation of material, the Dwell Units 25 and 26 can be moved on the preferred dual track rail system 40*a*, 40*b* toward and away from the radiation source 27 using the center line dose rate for a given product as a guiding parameter. This distance adjustment, of course, is performed between product runs, not during the product run. This feature allows the time and cost effective means of processing products with low and high dose requirements in the same irradiation facility.

The carriers are mounted on a parallel dual track system 25 and 26 which in turn can be re-positioned over a wide range of distances 25*a*, 26*a* perpendicular to the radiation source 27.

The audible alarm systems employed for the safety of the operation of T6-V include three different and distinct sounding alarms which warn of different conditions or occurrences in the irradiator 7. The pre-start up alarm system is initiated when the central key switch is activated at the rear of the Cell 28 starting the start up timer in the control system or until the timer runs out. The alarm will sound until the start up is initiated at the computer control system. A second audible alarm system is initiated informing all personnel every time the source rack 27 is raised or lowered from the source storage pool 27*a*. The third audible alarm is the emergency alarm which is sounded whenever an emergency or a potentially dangerous or unusual condition occurs. This third system is of course interlocked with heat, smoke, and seismic detector systems, all irradiator locks, as well as the central computer control system.

The products to be irradiated are conveyed into the Cell 28, by placing pallet loads of the product on a special multipurpose carrier system. Moreover, each carrier can move as much as 96 cubic feet and up to 2,500 pounds of product through the Cell 28.

The Dwell Units 25, 26 can be manipulated to be placed equal distances from the source rack 27, from as close as 15 cm to as far as several meters. This adjustment serves the purpose of affording a uniform radiation treatment of all the product being processed. This adjustable dwell unit thereby also helps prevent or minimize localized damage through heat denaturation of irradiated material by partial overdosage.

According to the preferred embodiment of the present invention, there are 3 different operating modes available for the conveyor. The variation is in the way the product is passed adjacent to the source rack in the cell. The Standard Operating Mode affords up to six containers of product in the Cell 28 at one time, such that the product remains at each of the 6 positions (1, 2, 3, 4, 5 and 6) on the Dwell Units 25, 26 for an equal time. The Dwell Units 25, 26 are always located in the same distance positions relative to the source rack 27.

The Second Operating Mode allows the product containers or pallets to stop at each of the 4 corner positions for equal periods of time. The Third Operating Mode is set up for the product containers or pallets to stop only on the central position on each Dwell Unit 25, 26 for equal periods or dose.

The preferred embodiment features shuttle cars (sometimes also referred to as transfer cars) using roller conveyor tops which move on parallel tracks 41, 42 on the cell floor. The typical operation envisions the following sequence. Shuttle car 22 moves pallets of product from the last length of conveyor 14 in the entrance maze 10 to the first dwelling position 1 on Dwell Unit 25 without changing the orientation of the pallet. Shuttle car 23 moves pallets of product from position 3 on Dwell Unit 25 to position 4 on Dwell Unit 26 again without changing the pallet orientation. Shuttle car 24 moves pallets of product from position 6 on Dwell unit 26 to the first length of conveyor 15 in the exit maze 11 while keeping the orientation of the pallet unchanged.

One preferred embodiment (FIG. 1) provides for as many as nine pallets of product to be queued on the lengths of conveyor in the entrance maze 10 to await entry into the Cell 28. Queuing positions include one pallet on transfer 17, one pallet at the end of the chain conveyor 20, one pallet on transfer 16, three pallets on conveyor 12, and three pallets on loading or starting conveyor section 29.

Overall a suitable distance is in part determined by the dosage required for the efficient irradiation of various products which are carried by the dual track system through the Cell, FIG. 1.

Figure 5:
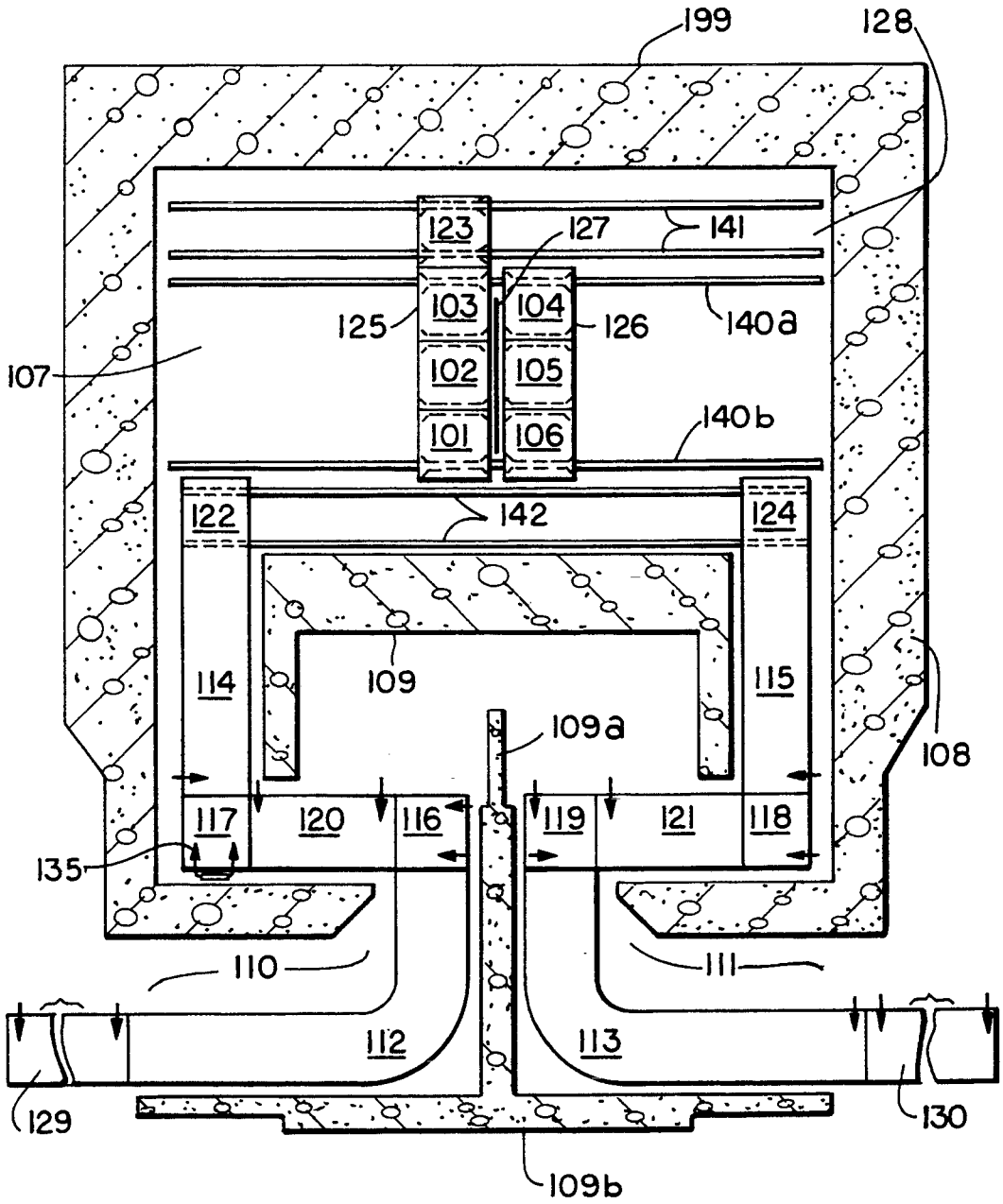
FIG. 5 illustrates a top plan view of an irradiation chamber in accordance with a preferred embodiment of the present invention.

Another preferred layout of the irradiator is illustrated in FIG. 5. The preferred embodiment shows certain additional shielding for improved environmental safety. In general, the graphic details of the facility of FIG. 5 are similar to those shown in FIG. 1. However, the reference numbers used are chosen as an equivalent series of 100's. Arrows have been added on the roller transport system to indicate the approximate location of sensorer, e.g. photoelectric eyes. Moreover, a pallet load can be positioned with precision on the rolling platform or tote assembly line 114 using an adjustable photoeye sensor 132 so that the edge of a given pallet on it can be placed as close to the inside edge of the roller conveyor 14 as possible. The location of the preferred conveyor motors is shown as follows: Conveyors 112, 116, 120, 117, 114, and Dwell Unit roller conveyor sections 101, 102, 103, 104, 105 and 106 utilize non-reversing AC motors. Shuttle car roller tops 122, 223 and 124 and conveyors 115, 118, 121, 119, 113, 130 and 129 utilize reversing AC motors. Movement of shuttle cars 120 and 124 and rails 142, of shuttle car 123 along rails 141, and of Dwell Units 125 and 126 along rails 140*a* and 140*b* is effected by reversing DC motors.

The versatility of the preferred embodiment of the invention derives from the fact that it incorporates multiple computer-controlled processing protocols for the purpose of administering a wide range of dosages, as required.

The process of irradiation can be monitored and controlled in a predetermined, programmable fashion by providing computer-linked sensor devices at suitable locations. Relevant information as to the substance, size and shape can be encoded on a suitable place on the product or on the platform transporting the product to be irradiated. A sensing device can read the encoded message and ascertain that it is suitable for the computer protocol currently operating the irradiator. In this manner, the conveyance and appropriate placement near the radiation source 27 of the product to be irradiated can be steered by remote control.

The computer-control system for this automated facility is used to activate or guide the facility components to transport the product using electric motors, hydraulic pressure, air pressure, or any other suitable power supply. Photo-eyes and limit switches serve to sense the location of product or the product conveyance system. Moreover, the program-linked system provides for an individual and selective shift in the position of the carriers as to a relatively proximal or distal location from the radiation source depending on the required dose. The change provides a spatial arrangement of the product so that the appropriate dosage exposure can be flexibly and automatically achieved.

A radiation sensing device can be provided to intermediately monitor the processing dosage effectively received by the materials being irradiated before entering the unloading phase of the conveyor. Such a monitoring device can be used to modulate and terminate the exposure of the material to gamma-rays by a feedback control such that the appropriate application of ionizing energy is effectively and safely achieved. In the same way, this automatic control device is intended to minimize or even prevent radiation damage through excessive overdosage.

The inventive modification of the dual track dwell unit transportation system provides an improved, economical way to expose material to the radiation source rack 27 by providing simultaneously two lines of conveyance 25 and 26 that can hold an equal number of carriers or pallets of product to be irradiated. As shown in FIG. 1, the distance of pallets in Dwell Unit positions 1, 2, 3, 4, 5, 6 from the irradiating source can be adjusted between positions 25 to **25*a* and 26 to 26*a***.

A preferred automated system of control over the dosimetry and concomitant handling for and during irradiation in the T6-V Irradiator is illustrated in Example 1.

EXAMPLE NO. 1

Bar Code Control

This procedure utilizes bar code readers which read the information of bar code labels representing numerical values indicating to the control system the product carried on the pallet. The computerized bar code offers certain advantages which will be readily apparent to the skillful practitioner. In addition to the safety aspect, the system allows control over precise localization, monitoring and recording of a given irradiation whereover, the system may be programmed to identify and record the irradiated product or portion thereof. Thus, the bar code system lends itself to simultaneously monitor and log the location and extent of the radiation dose for a particular product. The bar code readers, which are of at least two different types, are computer-linked monitoring mechanisms. One can be located at the entrance maze 10 to the Irradiator 7 and another at the exit maze 11, each performing a different, location-specific function.

In order to maintain maximum efficiency and to ensure that the correct products are subjected in the Irradiator 7 to the process currently programmed in the computer control system, the computer will check the reading obtained by the entrance bar code reader **12*a* prior to allowing each pallet to be loaded into the Irradiator 7**.

As pallets of product enter the irradiator 7 from the entrance maze 10 at the end of conveyor length 29, a bar code reader reads the information on the bar code label. The numerical value read is checked against the expected numerical value reading in the computer control system. If the numbers match, the pallet will be permitted to proceed into the Irradiator 7 for suitable processing. However, if the numbers do not match, the conveyor will be automatically halted, and the pallet must removed prior to further loading of pallets as programmed by the control system.

The bar code reader at the exit 11 from the irradiator 7 reads the bar code labels on the pallets exiting from the irradiator 7. The radiation dose can be identified by the colorimetric reading of color changes effected by the dosage. The information is appropriately recorded and stored by the computer memory linked to the system.

The presently preferred method of the invention utilizes radiochromic indicators of radiation dose received on the bar code labels wherein the color change depends on gamma-ray polymerization of diacetylenes such as, e.g., 2,4-hexadiyne-1,6-diol bis-(p-toluene).

Usually, the bar code label has those sections of which the entrance bar code reading device will read the first section of information coded to verify appropriate numbers for the irradiation process. The exit bar code reader reads all three parts of information entered on the label, such as, e.g. a product number, a programming message, telling the reader to read the colorimetric strip indicator of the absorbed dose, and finally the actual color-changing radiation strip indicator.

The entrance bar reader will read all the various items important to the performance of the irradiation process, such as verify correct loading of pallets of product into the irradiator.

This label is affixed at a suitable location on the pallet or carrier so as to be accessible to the reading or monitoring apparatus. Alternatively, materials to be irradiated which are enveloped in the so-called method of stretch-wrapping can be affixed with a bar-code label in an appropriately accessible part of the package.

The bar code reader can be a hand held optical scanner, or a fixed laser scanner system. Of course, all the data exhibited on the bar code label is stored and printed by a suitable computer system.

In one advantageous version of the present invention, all the steps in the procedure can be directly and flexibly manipulated by one or more operators using microcomputers which are linked to the various operative phases of the Irradiator.

Another rapid and efficient manner of monitoring can be achieved by utilizing a fiber optical sensor means as part of an automatic control or operating system.

In another advantageous embodiment of the T6-V facility a programmable controller stores all possible product flow sequences in its memory. The programmable controller interfaces with a microcomputer through a proprietary data highway. All processing records are printed out at the control station, and by use of modems the certifications can be transmitted electronically to a quality control or regulatory office. This special feature of remote computer control permits remote trouble shooting which minimizes cost, down time, and risk of exposure.

One preferred automatic conveyor operation is described as follows:

EXAMPLE NO. 2

Automatic Mode

Pallets are loaded onto the roller conveyor line 29 in groups of up to three using e.g., a forklift truck.

The start button is pressed on the loading control panel, if conveyor 12 is clear and the bar code reader permits entry, all three pallets are transferred. The pallets will move until the photo-eye 12*a* at the far end of line 12 senses the first pallet.

The hydraulically actuated roller transfer 16 accepts a pallet from conveyor 12 when it is in a raised position. A diffuse photo-eye 16*a* will sense presence of the pallet on roller transfer 16. Remaining pallets on conveyor 12 will move forward to the end of 12.

The roller transfer 16 lowers, and the pallet is moved to the end of chain conveyor 20. If the pop-up transfer 17 is clear, the pallet will be transferred onto same surface 17 while it is in the down position. The pallet is held at position 17 (up level) until such time as it can be moved without interruption to position 1 on the first dwell unit, DU1, 25.

Thus the pallets awaiting irradiation are at this moment held in the following positions;

(a) One pallet on second transfer 17 in the raised position.
(b) One pallet at the end of the chain conveyor 20.
(c) One pallet on first transfer 16 in the raised position.
(d) Three pallets on roller conveyor 12.
(e) Three pallets on loading roller conveyor 29.

In anticipation of a call for a pallet for position 1 on DU1 25, the pallet waiting first in line on roller transfer 17 will move to the end of 14 and then onto shuttle car 22 which moves to the loading end of DU1 25. The Programmable Logic Controller (PLC) notes or times the arrival of the shuttle car 22 at the end of DU1 25*a*. At this time, a second shuttle car 23 will be ready at the off-loading end of DU1 25.

The pallets on DU1 25 and the one on shuttle car 22 all move forward at the same time. If there was a pallet in position 3 on DU1 25, it moves of course onto the shuttle car 23 which moves to the loading position of DU2 (26). The first or accessing shuttle car 22 returns to await the next pallet at the end of conveyor 14. Shuttle car 24 will be positioned at the unloading end of DU2 (26).

The pallets on the second dwell unit, DU2, 26, and that on the second shuttle car 23, all move forward at the same time. If there was a pallet in position 6 on DU2 26 it is moved onto the third shuttle car 24.

Shuttle car 23 returns to the unloading end near position 3 of DU1 (25) to await the end of the next dwell time period. Shuttle car 24 moves to the loading end of the roller conveyor 15. The pallet on shuttle car 24 is transferred to 15 and moves to the end of the conveyor 15 near transfer position 18.

The pallet at the end of conveyor 15 is then moved onto the pop-up roller transfer 28, which will be in the raised position. It then is lowered automatically and the pallet is moved to the end of the second, existing chain transfer 22. The pallet is then transferred onto pop-up transfer 19 in the down position.

The exit transfer 19 raises, and the pallet is indexed forward onto the existing roller conveyor line 13. Three pallets can be accumulated there before they are transferred onto the unloading conveyor 30.

When the operator pushes the start button on the unloading control panel, the pallets on conveyor line 13 will be transferred forward onto the unloading conveyor 30. When a pallet is sensed at the end of 30, the conveyor will stop, and the pallets can then be off-loaded.

Thus the following storage positions are available to processed pallets exiting the radiation room:

(a) Three pallets on the unloading line 30.
(b) Three pallets on the exiting line 13.
(c) One pallet on transfer 19 in the up position.
(d) One pallet at the end of the chain conveyor 21.
(e) One pallet on roller transfer apparatus 18 in the up position.

The automatic operation depends on the following conditions:

The loading control panel has STOP, START and REVERSE buttons which may be used in controlling the operation of the conveyor 29.

Prior to commencing and irradiation operation, the dwell units are automatically positioned at the required distance from the source rack according to the specification in the product protocol stored in the computer control system. The position of the dwell units can not be varied at any time during a product run, only between product runs.

If there is no pallet available on the roller transfer 17 when the demand arises, a gap is allowed to pass through the system in the form of an imaginary pallet.

If, for any reason, a shuttle car is not available at either the end of DU1 (25) or DU2 (26) at the end of a dwell time period, the irradiator is automatically shut down to avoid overdosing the product.

While product is being removed from the Irradiator 7 it is scanned for any excess radioactivity when it transfers along chain conveyor 21. If excess radioactivity is detected on the pallet of product while on the exiting chain conveyor 21, the Irradiator 7 is shut down, and the contaminated pallet is moved back onto the transfer 18 and then back further to the beginning of conveyor line 15.

If the third shuttle car 24 moves to conveyor line 15 to unload a pallet, and another pallet is detected at the end of the line 15 awaiting further unloading, the pallet cannot be transferred from the shuttle car 24 to conveyor line 15. At the end of dwell time period, the irradiator automatically shuts down.

The unloading control panel has START, STOP and REVERSE buttons for controlling.

Another preferred embodiment of the invention is exemplified in the simple manual batch mode operation for sequential irradiation, as described below:

EXAMPLE NO. 3

Batch Mode

When operated in the batch mode, six pallets are loaded manually into the six dwell positions on the two dwell units while the source is its storage mode. The irradiator would be operated in the batch mode under the following two scenarios:

The loading and unloading lengths of conveyor in the entrance 10 and exit 11 mazes are not installed into the irradiator 7. Only two shuttle cars 22 and 23 or 24 are in place, one at either end of the two dwell units 25, 26.

The accessing conveyor 14 is installed. When there is a small run, the pallets are transferred into the radiation room or Cell 28 while the source rack 27 is in its safe storage position, immersed in the source storage pool 27*a* and are positioned on the six dwell positions 1, 2, 3, 4, 5, 6, in the two dwell units 25 and 26. The source rack 27 is raised, the six pallets are moved automatically around the source rack 27 until each one has dwelled for a constant time in each of the six dwell positions 1, 2, 3, 4, 5, 6. The source rack 27 is then lowered into the storage position 27*a* and the pallets are removed via the exit conveyor 15.

The loading and unloading of pallets for a batch run are accomplished as follows:

The irradiator is set up for a batch operation at the control panel. The operator enters the radiation room to load the pallets onto the dwell units.

A hand held controller which is attached to an extension cord from the power distribution box in the exit maze 11 is brought into the radiation room 28.

If no entrance conveyor length 14 exists, a pallet is manually placed onto the shuttle car 22 while it is at the position corresponding to the end of line 14. If the entrance conveyor 14 is installed, the pallets are transferred into the Cell 28 using the same technique as in the automatic operation, and they will await irradiation or loading at the same six positions as used during automatic operation, whereby each pallet is at one of the six positions for a dwell-time sufficient for suitable irradiation.

The loading and unloading procedure is approximately as follows:

The LOAD button is pushed on the hand held controller. If there is no entrance conveyor, the pallet on the shuttle 22 will be loaded onto the first dwell unit DU1 25. If an entrance conveyor 14 is being used, the pallet being held on the transfer position 17 will transfer to shuttle car 22 and be loaded onto DU1 25. This step is repeated five times until there are six pallets on the dwell units 25, 26.

It is understood that on the other side of DU1 (25) the other shuttle 23 moves pallets to DU2 (26) where the three possible positions proceed in the opposite parallel direction past the source rack.

The SET button on the hand controller is pressed, and shuttle car 22 moves to its batch wait position at the end of the second dwell unit, DU2, 26.

At the end of a batch run of a system with maze conveyors, the operator manually changes the positions of the limit switch strikes and then presses the RESET button on the hand control. The conveyor will automatically return itself to the load mode. Shuttle car 24 will be present, and will be used to unload the pallets via the exit conveyor in the normal way. One press of the UNLOAD button will be required to initiate unloading of all pallets.

In an irradiator without maze conveyors, the first shuttle 22 will be used to unload the Dwell Units. The operator will adjust the limit switch as necessary and press the UNLOAD POSITION button, which moves shuttle 22 into the position from which pallets are manually unloaded from it. Each time a pallet is to be removed, the UNLOAD button is pressed, the shuttle car 22 will move to the end of DU2 26, accept a pallet, move to the unload position and stop. When all pallets have been unloaded, the operator will again press the RESET button. Shuttle car number one (22) will move into the loading position.

The following is a description of an actual batch operation:

Step 1. Six pallets are loaded into the dwell positions on the two dwell units 25, 26. This is done manually or via the entrance conveyor, depending on the situation described above. If the full conveyor system is installed, shuttle car number 24 is moved to the extreme position at the loading end of unloading conveyor 15. The first shuttle 22 waits at the end of DU2 26 and shuttle number two 23 waits at the end of DU1 (25).

Step 2. The source rack 27 is raised and the timer begins counting one dwell time period.

Step 3. At the end of one dwell time period, the three pallets on DU1 25 move forward, and the pallet in position 3 on the dwell unit DU1 25, moves onto the shuttle car 23 for transfer. Simultaneously, the pallets on DU2 26 move forward, and the pallet in position 6 on DU2 26 moves onto shuttle one 22. The next shuttle car 23 moves to the loading end of DU2 26 at the same time as shuttle 22, moves to the loading end of DU1 25. The pallet on shuttle car 23 moves into the open dwell position 4 on dwell unit two (26) while the pallet on shuttle car 22 moves into the open dwell position 1 on dwell unit DU1, 25. Shuttle car 23 returns to the unloading end of dwelling unit DU1 25 while shuttle one 22 moves back to the unloading end of the other dwell unit DU2, 26. Step 3 is repeated five times, until all pallets have dwelled in each of the six dwell positions (1, 2, 3, 4, 5, 6).

Step 4. At the end of the sixth dwell time period, the source rack is automatically lowered. The pallets are now either manually removed from the radiation room, or, if the full conveyor is in place, removed on the conveyor system from the radiation room.

Further advantages of the present invention can be seen in the flexibility of the use of the facility. During both batch and automatic runs, the two dwell units together can operate in one of three routines:

(1) using only the central position 3, 5 of each dwell unit for a maximum of two pallets in use at a time;

(2) using only the two end positions of the dwell units allowing a maximum of four pallets on the two dwell units 25, 26 at a time; and (3) using all three dwell positions on each of the two dwell units 25, 26 for a maximum of six pallets 1, 2, 3, 4, 5, 6 on the two dwell units. Of course, the exposure routine is further defined by describing the distance between the source rack and the dwell unit.

EXAMPLE NO. 4

Figure 2:
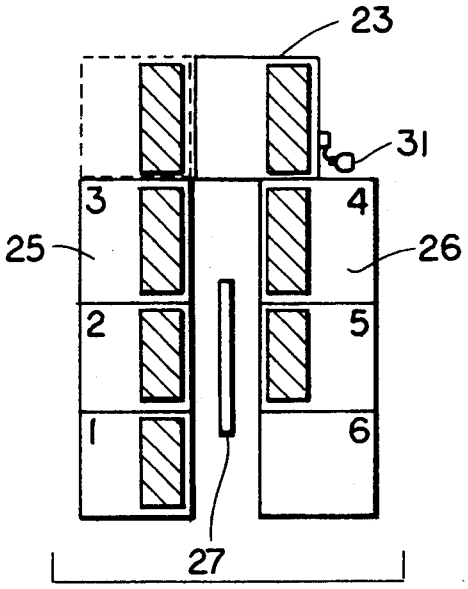
FIG. 2 is a top plan view of the dwell unit and source rack area with partial or reduced width pallet loading.

Load Shifting (See FIGS. 2 and 3)

In a case as shown in FIG. 2 where pallets are in use which have a width dimension smaller than the standard pallet (ca. 40 in. wide, 48 in. long) the conveyor system around the two dwell units has to be utilized to transfer such a pallet from a position closest to the source rack 27 on dwell unit 25 to a position closest to the source side on the other dwell unit 26. This maneuver is accomplished by limiting the extent to which the shuttle car 23 can move from the off-loading end 3 of dwell unit 25 to the loading end 4 of dwell unit 26. The limiting means is achieved by manually adjusting the strike 31 with which the halt limit switch on shuttle car 23 normally interfaces.

Each programmed routine of a particular product can be automatically loaded into the computer by entering the product protocol number into the personal computer (PC) during the start-up procedures.

Another advantage of the present invention is provided by the capability of modifying the manual batch irradiator to a fully automatic irradiator without the need for drastic programming changes.

Figure 3A:
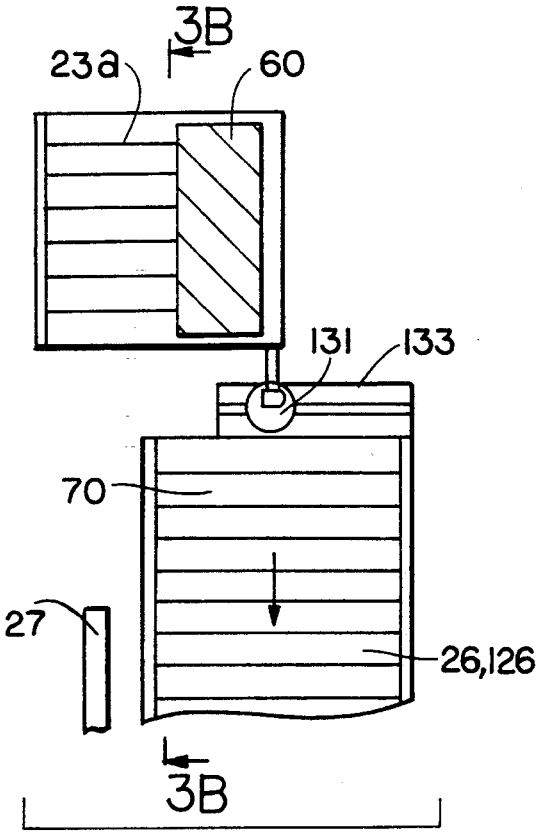
FIG. 3A is a top plan detail view of the transfer of a reduced width pallet.
Figure 3B:
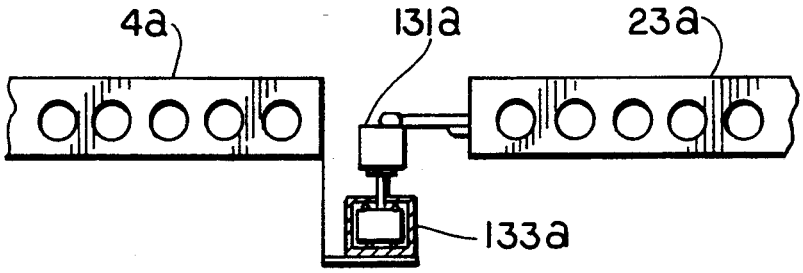
FIG. 3B is a detail side view of FIG. 3A (A—A) of the shuttle platform and the slidably adjustable limit switch.
Figure 3C:
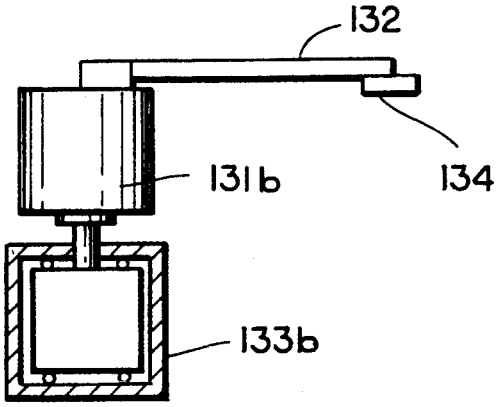
FIG. 3C an expanded view of the adjustable limit switch of FIG. 3B.

Taking FIG. 3A as detail illustration of the strike contact 131 adjusted in the guide housing 133 on DU2 126 to a position which allows equidistant irradiation. FIG. 3B further shows transversely along section A . . . A in FIG. 3A the position of the strike 131*a* and its anchorage in the guide housing 133*a* between the end portion of DU2 4*a* and the shuttle 23*a* carrying a partial load 60. FIG. 3C illustrates the configuration of a strike switch contact control system used to optimize the load shifting operation as described.

EXAMPLE NO. 5

Dwell Unit Distance Adjustment (FIG. 4)

Figure 4A:
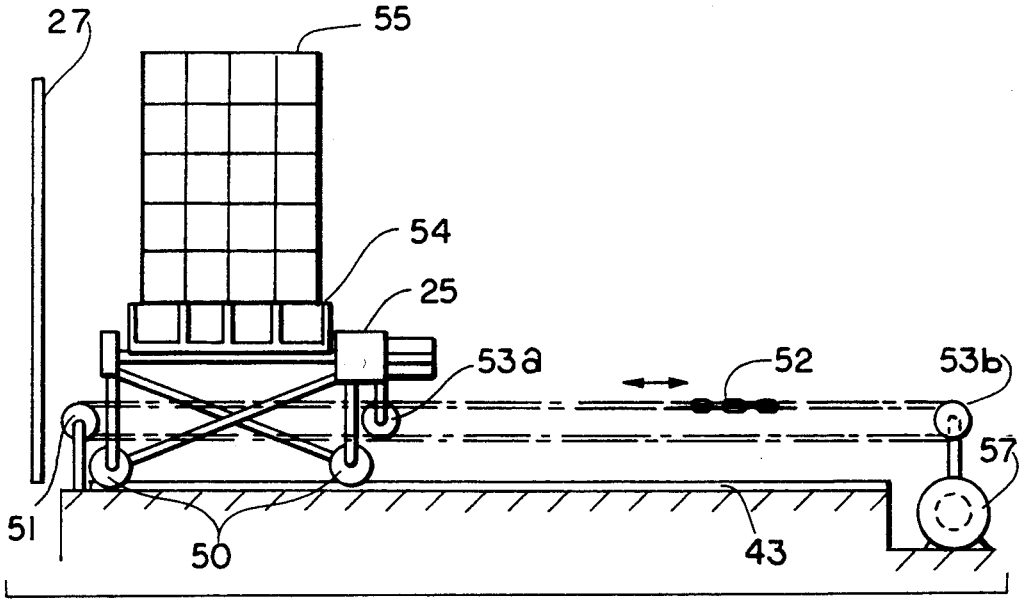
FIG. 4A shows a side view of the dwell unit movement mechanism.
Figure 4B:
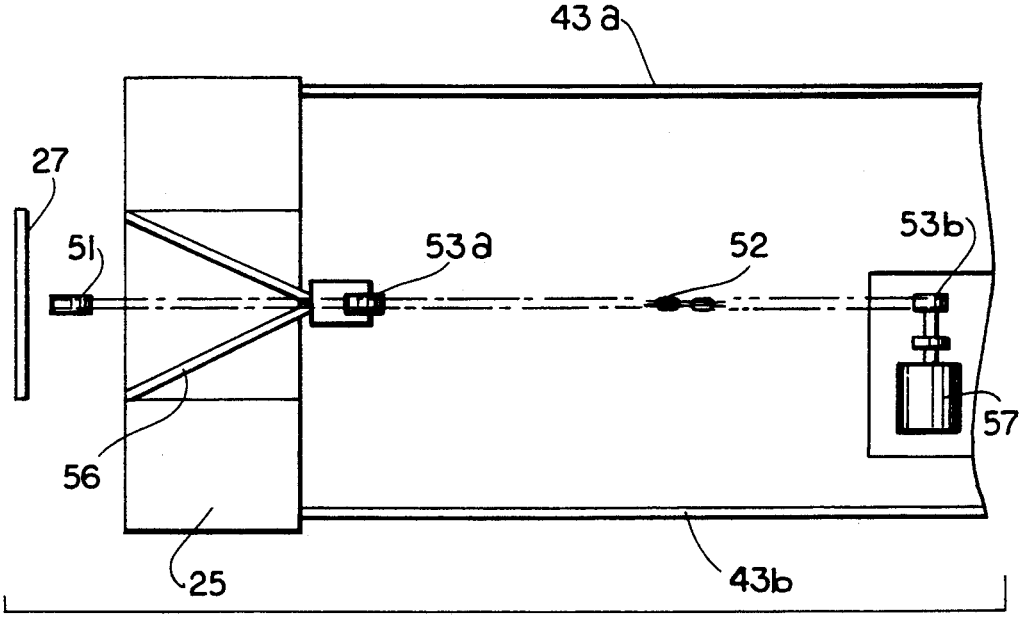
FIG. 4B shows a bottom view thereof.

As a preferred embodiment the variable distance at which the pallet loads are irradiated can be controlled by adjusting the position of the dwell units, DU1 or DU2, with respect to the radiation source rack. Such a preferred embodiment is illustrated in FIGS. 4A and 4B. For example, the DU1 (25) is moved on wheels 50 on two parallel rails (43; 43*a*, 43*b*) closer to or farther from the source rack 27 depending on needed radiation dose rate. The means for moving and locating DU1 (25) is comprised of, e.g., an electric motor 57 which drives a gear (53*b*) drives a chain (52) wound over a second gear or pulley (51) where the DU1 (25) carriage 56 is attached by a joint 53*a* in the chain (52).

Similar means are used of course as in a mirror image on the other side of the rack 27 to move DU2 (26).

Another preferred embodiment 199 of the invention is shown in FIG. 5 wherein, all the details are referenced as in FIG. 1 except for the numbers being in 100's. Photo-eyes or limit switches for the automatic monitoring or control of pallets on entrance and exit conveyors are positioned as shown in FIG. 5. Two parallel arrows ("↑ ↑") signify the approximate boundary to the range of locations of an adjustable photoeye for positioning loads of different width. A single arrow indicates the presence of a retro-reflective photo-eye which used for monitoring the position of the loads at various positions along the track in and out of the irradiator.

The layout and configuration of the Cell 128, however, is changed for the wall section 109 and, more importantly, sections 109*a* and 109*b*.

The wall enclosure extensions 8*a*, 8*b* illustrated in the embodiment of FIG. 1 were removed in order to accommodate curving the loading and unloading tracks (112, 113) sharply outward and away from the open portion of the cell maze as shown. This layout advantageously affords the persons at positions 110 or 111 attending the loading or unloading of the pallet conveyor 112, 113 better protection or avoidance of chance exposure to radiation.

Another preferred aspect of the embodiment 199 in accordance with FIG. 5 is the position of wall section 109*b* in perpendicular direction to the entrance and exit maze openings (110, 111), thereby further containing any excess or accidental radiation emanating from the Cell 128.

Processing conditions of the various materials and products are variable depending on several factors such as source, product size, material density, irradiation purpose, location and position of products relative to the radiation source, time of processing and range of allowed or required dosage.

The following is an example of the irradiation of medical products for the purpose of sterilization (Table I):

TABLE I

| | |
|---|---|
| 1. Pallet size | 40 × 48 × 76" high |
| 2. Product Density | 0.123 g/cc |
| 3. Desired Minimum Dose | 1.5 M Rads |
| 4. Maximum Dose | 2.08 M Rads |
| 5. Cobalt Loading | 1,000,000 Ci |
| 6. Dwell Unit Location | Closest in position |
| 7. Routine | Mode 3 (all 6 positions used) |
| 8. Dwell Time | 17.18 minutes |
| 9. Irradiation Purpose | Sterilization |

The conditions or factors of irradiation are often interdependent. Items 3 and 4 are dependent upon item 9. Item 8 is dependent on Item 3 and effected by item 5 and 6. Item 6 is dependent upon items 3 and 2.

Different desired results include, but are not limited to, sprout inhibition, insect disinfestation, sanitization, bacteria and pathogen elimination and sterilization of food products, sanitization of cosmetic products, sterilization of medical and pharmaceutical products, sterilization of infectious wastes, and polymerization of plastics. Each process has different operating characteristics. The T6-V Irradiator is the only irradiator to adequately address the processing variations between the different processes.

While the invention has been described with reference to the presently preferred embodiment thereof, it should be apparent to those skilled in the art that various modifications and changes in construction can be incorporated without departing from the true spirit of the invention as defined in the appended claims.

What is claimed is:

1. An irradiation facility for controllably irradiating products with gamma-rays comprising:

(a) a radiation source;

(b) means for loading a plurality of product to be irradiated on a carrier means;

(c) conveyor means for conveying product carrier means to two movable dwell units positioned in parallel proximity of the radiation source, said carrier means supportable by said movable dwell units such that said dwell units carry said carrier means when said dwell units move, said dwell units capable of maintaining constant spatial orientation of said carrier means relative to said radiation source;

(d) means for adjusting the position of the movable dwell units on either side of the radiation source;

(e) means for adjusting the position of the product carrier means on the dwell units;

(f) means for storing the radiation source in a radiation protective storage tank, which comprises a water-filled storage pool or a dry storage shielding cask;

(g) means for moving irradiating source into position for applying irradiating dosage to each carrier; and (h) computer-linked sensor means therefor;

the irradiation facility having a radiation shielding wall enclosure open at one end, which end also comprises a recessed interior wall complex located for barrier-free conveyance of products to and from the radiation source.

2. The facility as claimed in claim 1, wherein the plurality of product comprises food, nutrients, or potables, cosmetic, medical or pharmaceutical products, toxic or infected waste.

3. The facility as claimed in claim 1, wherein the irradiation dose serves to preserve, process, or sterilize.

4. The facility as claimed in claim 1, wherein the irradiating source are selected from the group consisting of Cobalt-60 or Cesium-137.

5. The facility as claimed in claim 1, wherein the computer-linked sensor means is an automated radiation dosimetry system based on bar-coding.

6. The facility as claimed in claim 5, wherein a bar-code reader is at the entrance and exit phase of the conveyance means.

7. The facility as claimed in claim 1, wherein the conveyor means is a motorized roller track.

8. The facility as claimed in claim 1, wherein the dwell units are motorized for remote-control adjustable positions on either side of the radiation source, the positions being adjustable both in parallel and perpendicular directions.

9. The facility as claimed in claim 1, wherein the carrier means comprise pallets of various sizes.

10. The facility as claimed in claim 1, wherein the position of the carrier means relative the radiation source is controlled by limit switches.

11. The facility as claimed in claim 1, wherein the computer-linked sensor means coordinate, modulate, and terminate exposure to the radiation source of the product to be sterilized.

12. An irradiation facility for the remote-controlled treatment of a plurality of products or materials comprising:

(a) a radiation source;

(b) a conveyance system for transporting the products or materials on at least two movable parallel conveyors in a suitable proximity of the radiation source;

(c) the conveyance system having a plurality of carriers for the products or materials to be irradiated;

(d) the carriers being selectively transported to control speed, time and duration of irradiation and said movable parallel conveyors are capable of maintaining constant spatial orientation of said carriers relative to said radiation source;

(e) the parallel track conveyance system having motorized means to vary the track position relative to the radiation source; and (f) the remote control of the irradiation process being monitored and directed by a computer-linked reader system, the reader system being a laser equipped detection device.

13. The irradiation facility of claim 12 wherein the remote-controlled treatment of products or materials comprises preserving or sterilizing foods, medical or pharmaceutical products; sanitizing cosmetic products; radiation processing of bonding plastics, alloys, or emulsions; sterilizing or inactivating waste products; radiation processing or sterilizing of food packages or utensils.

14. The irradiation facility of claim 13 wherein the remote-controlled treatment includes a loadshifting adjustment for uniformly irradiating product on pallets which are smaller than standard size.

15. A method for controllably irradiating a product with gamma-rays in an irradiation facility, comprising the steps of:

(a) placing the product to be irradiated in a carrier means mounted on a roller conveyor means;

(b) moving the carrier means on the conveyor means with connecting shuttle means to different positions on parallel conveyor tracks in proximity of the radiation source;

(c) adjusting the distance of the parallel conveyor tracks respective the radiation source;

(d) placing the radiation source into position for irradiation;

(e) irradiating the product with a radiation dosage while maintaining constant orientation positions of said carrier means relative to said radiation source; and (f) optionally monitoring by a sensor means and controlling by the remote control means, the position of the parallel conveyor tracks, the placement of the radiation source, and the dosage of irradiation.

16. The method as claimed in claim 15 wherein the product comprises food, nutrients, or potables, cosmetic, medical or pharmaceutical products, infected or toxic waste substances.

17. The method as claimed in claim 15, wherein the controlled irradiation comprises a preserving, inactivating, sanitizing or sterilizing dose.

18. The method as claimed in claim 15, wherein each of the two parallel conveyor tracks comprise at least three dwell subunits.

19. The method as claimed in claim 15, wherein the conveyor tracks comprise a chassis with wheels running on a dual rail track system.

20. The method as claimed in claim 15, wherein the radiation source is selected from the group consisting of Cobalt-60 and Cesium-137.

21. The method as claimed in claim 15, wherein the carrier means comprises pallets.

22. The method as claimed in claim 15, wherein the conveyor means are motorized rollers.

23. The method as claimed in claim 15, wherein the computer-linked sensor means comprise an automated radiation dosimetry system based on bar-coding.

24. The method as claimed in claim 23, wherein the bar-coding is monitored by bar code reader at the entrance and exit portion of the conveyance system.

25. A method for treating food, medical or cosmetic products, utensils, devices or other products or materials by remote-controlled irradiation with gamma-rays comprising the steps of:

(a) placing product to be irradiated on a plurality of carriers, the carriers being mounted in an assemblyline tote system and being connected to remote control means; the assemblyline tote system comprising at least two parallel conveyor tracks positioned in proximity to a radiation source connected to the remote control means;

(b) moving by remote-control the parallel conveyor tracks to different positions in the proximity of the radiation source to effect radiation processing; and (c) monitoring the remote-controlled irradiation process by an automated dosimetry system using barcode labelling and radiation colorimetry.

26. The method as claimed in claim 25 wherein the assemblyline tote system comprises conveyance controls allowing loadshifting of smaller than standard size carriers for uniform irradiation.

* * * * *